US005651497A

United States Patent [19]

Ventura et al.

[11] Patent Number: 5,651,497

[45] Date of Patent: Jul. 29, 1997

[54] BREAK-AWAY PACKING CASE

[75] Inventors: Michael C. Ventura, Strongsville; Darlene A. Zelasko, Sagamore Hills, both of Ohio

[73] Assignee: The Sherwin-Williams Company, Cleveland, Ohio

[21] Appl. No.: 658,982

[22] Filed: Jun. 4, 1996

Related U.S. Application Data

[63] Continuation of Ser. No. 417,412, Apr. 5, 1995, abandoned.

[51] Int. Cl.[6] ..... B65D 17/28

[52] U.S. Cl. ..... 229/235; 229/924

[58] Field of Search ..... 229/117.16, 117.18, 229/235, 237, 243, 925, 926, 924; 206/44 R, 45.12

[56] References Cited

U.S. PATENT DOCUMENTS

| | | | |
|---|---|---|---|
| 1,656,919 | 1/1928 | Marsh . | |
| 2,146,420 | 2/1939 | Davidson . | |
| 2,407,415 | 9/1946 | Graziano . | |
| 2,807,401 | 9/1957 | Smith . | |
| 3,542,192 | 11/1970 | Steck . | |
| 3,687,278 | 8/1972 | Graham et al. | 229/235 X |
| 4,008,849 | 2/1977 | Baber | 229/235 X |
| 4,058,206 | 11/1977 | Morse et al. | 229/240 |
| 4,113,100 | 9/1978 | Soja et al. | 229/235 X |
| 4,271,964 | 6/1981 | Train . | |
| 4,318,474 | 3/1982 | Haseqawa . | |
| 4,421,229 | 12/1983 | Pan et al. . | |
| 4,482,055 | 11/1984 | Boyle . | |
| 4,718,597 | 1/1988 | Bishop | 229/117.16 |
| 4,793,487 | 12/1988 | Bentsen et al. . | |
| 5,333,777 | 8/1994 | Roth | 229/117.16 |

*Primary Examiner*—Allan N. Shoap
*Assistant Examiner*—Christopher J. McDonald
*Attorney, Agent, or Firm*—Heidi A. Boehlefeld; James A. Hudak

[57] ABSTRACT

A packing case for cans or containers that can be readily opened without the use of a cutting tool and, when opened, provides a tray for the display of the contents of the packing case is disclosed. A tearing score is provided in each side panel of the packing case and has a configuration allowing the weight of the cans or containers within the case to cause the separation of the top portion of the case from the bottom portion when the top portion is lifted upwardly, such separation producing a relatively smooth edge on the bottom portion of the case which can be used for display purposes. A lifting access opening, reinforced by reinforcement material, is provided in each side panel adjacent the bottom panel of the packing case to assist in the lifting of same.

10 Claims, 2 Drawing Sheets

BREAK-AWAY PACKING CASE

This is a continuation of application(s) Ser. No. 08/417,412 filed on Apr. 5, 1995, abandoned.

TECHNICAL FIELD

The present invention relates, in general, to a packing case for shipping cans or containers and, more particularly, to a packing case that is formed from a blank of corrugated board having folding scores defining the outer edges of the case and tearing scores through the approximate center of its side panels permitting the top portion of the case to be readily separated from the bottom portion thereof.

BACKGROUND ART

Cans and/or containers are typically packaged in conventional packing cases formed from blanks of corrugated board having folding scores incorporated therein to define the outer edges of the case. Such cases usually require the use of razor-type knives to open same or to cut its side panels to form a tray so as to expose its contents for price marking and/or display purposes. The use of such knives can result in cutting or defacing the cans or containers within the case reducing the value of the cans or containers or requiring that the cans or containers be discarded.

There have been attempts to overcome the inherent problems associated with opening packing cases with razor-type knives or using such knives to form a tray for display purposes. For example, U.S. Pat. No. 3,542,192 (Steck) discloses a packing case wherein each side panel is provided with a tearing score comprised of two perforated parallel broken lines, the perforated slots of one line being opposite the uncut spaces of the other line and the ends of the slots on each of the lines slightly overlapping one another. A disadvantage of the foregoing tearing score configuration is that when the top portion of the case is separated from its bottom portion, the tearing score produces a crenelated, rather than a smooth, edge resulting in a rather unattractive tray for display purposes. In addition, in order to open the packing case disclosed in the foregoing patent, a person must insert his fingers through the perforated slots forming the tearing score in each side panel and pull the top portion of each side panel outwardly while pressing downwardly on the top panel of the case causing the top portion of the side panel to break away from its bottom portion along the tearing scores. Thus, opening the packing case disclosed in this patent is a rather cumbersome process and the weight of the cans or containers within the case is not utilized to assist in the opening process. Furthermore, it should be noted that the packing case disclosed in this patent does not include lifting access openings in the side panels to assist in the lifting of the case.

Because of the foregoing inherent disadvantages associated with presently available packing cases, it has become desirable to develop a packing case which includes tearing scores providing a relatively smooth edge on the bottom portion thereof (the tray) after the top portion of the case has been separated therefrom, and which includes reinforced lifting access openings in the side panels thereof.

SUMMARY OF THE INVENTION

The present invention solves the problems associated with the prior art packing cases and other problems by providing a packing case that does not require a razor or the like to open same and which incorporates tearing scores that provide a relatively smooth edge on the bottom portion of the packing case when the top portion is separately therefrom. Each tearing score is comprised of a series of perforated slots which extend through the side panels and through the adjacent end flaps. A finger opening is provided adjacent each tearing score. The tearing scores are configured and positioned so that by placing one's fingers in one of the finger openings in a side panel or in a finger opening in each of the oppositely disposed side panels and then lifting upwardly, the weight of the cans or containers within the packing case causes the top portion of the packing case to separate from the bottom portion thereof along the tearing scores resulting in a relatively smooth edge on the bottom portion of the case, i.e. , the tray which is used for display purposes. The weight of the cans or containers opposes the upward force provided on the packing case through the finger openings causing the top portion of the packing case to separate cleanly from the bottom portion along the tearing scores.

A lifting access opening is provided in each side panel adjacent the bottom panel of the packing case permitting the lifting of the packing case from the bottom. A strip of reinforcement material is provided within each side panel and is positioned adjacent to and above each lifting access opening so as to minimize tearing of the lifting access openings.

Accordingly, an object of the present invention is to provide a packing case wherein the top portion is readily separable from the bottom portion thereof along tearing scores.

Another object of the present invention is to provide a packing case wherein the weight of cans or containers within the packing case causes the top portion of the case, when lifted upwardly, to separate from the bottom portion along the tearing scores.

A still another object of the present invention is to provide a packing case having lifting access openings in the side panels adjacent the bottom panel thereof.

A still another object of the present invention is to provide a packing case having a strip of reinforcement material within each side panel adjacent the lifting access opening to minimize tearing of the lifting access openings.

DESCRIPTION OF THE PREFERRED EMBODIMENT

Figure 1:
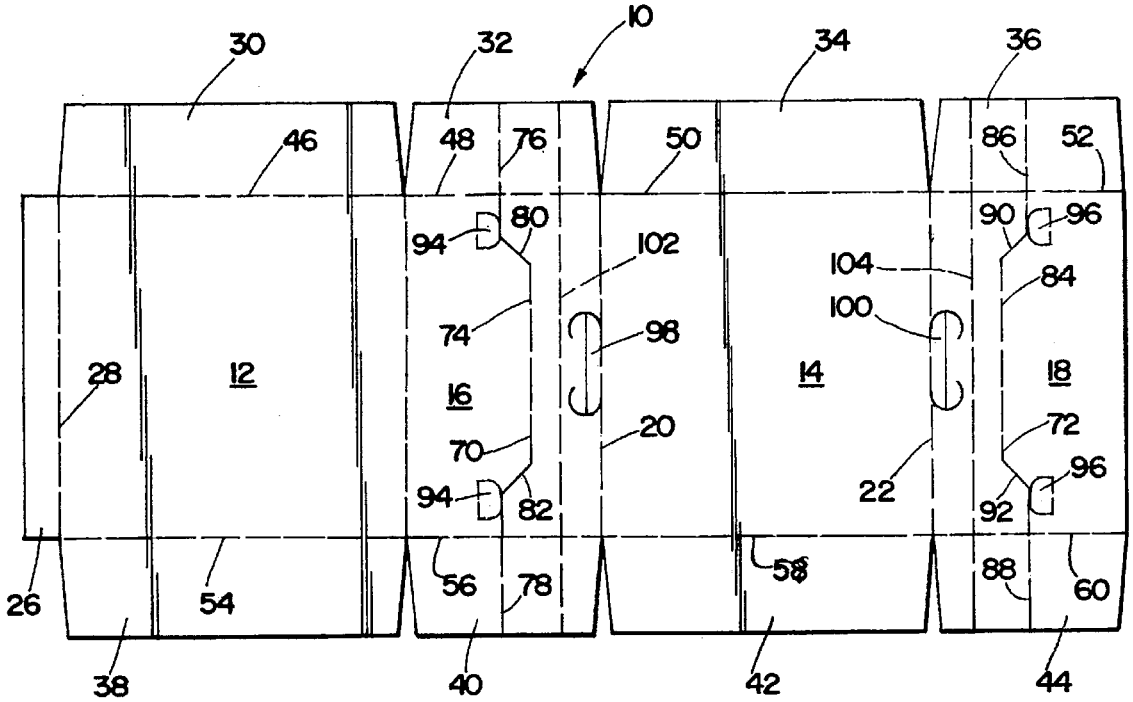
FIG. 1 is a top plan view of the blank from which the packing case of the present invention is formed.

Referring now to the drawings where the illustrations are for the purpose of describing the preferred embodiment of the present invention and are not intended to limit the invention described herein, FIG. 1 is a top plan view of a blank 10 from which the packing case of the present invention is formed. The blank 10 is comprised of a top panel 12, a bottom panel 14, and side panels 16 and 18 hingedly connected to the opposite edges of bottom panel 14 by folding scores 20 and 22, respectively. The opposite edge of side panel 16 is hingedly connected to top panel 12 by a folding score 24. A glue flap 26 is attached to the opposite edge of top panel 12 by a folding score 28.

Figure 2:
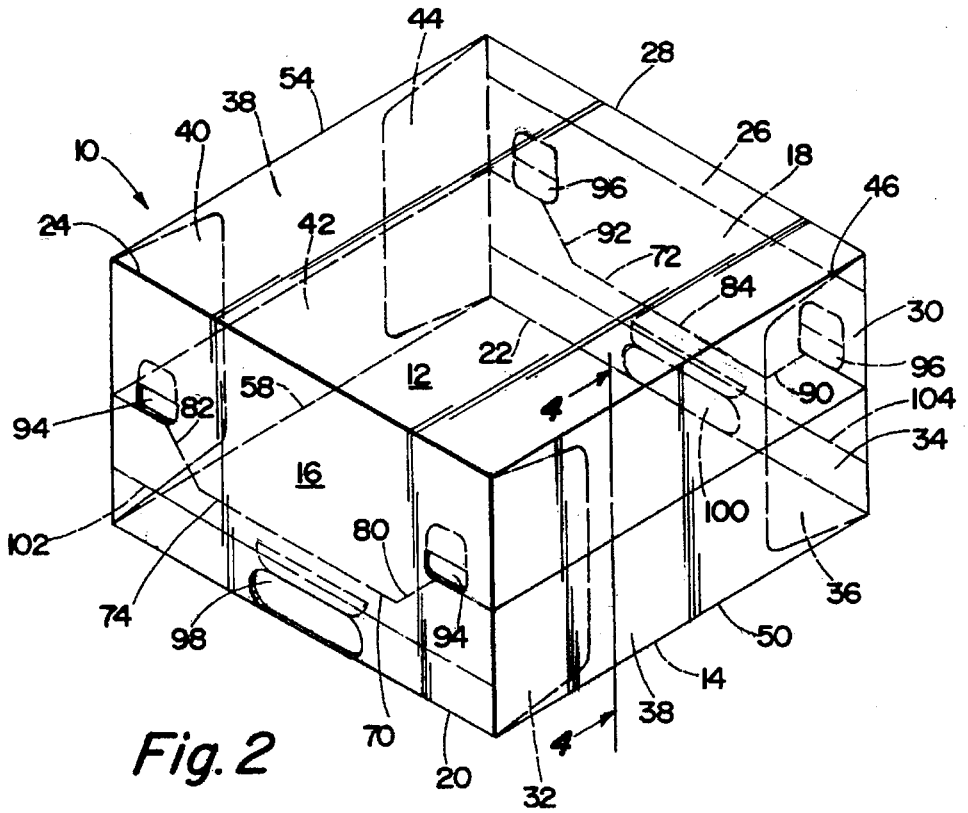
FIG. 2 is a perspective view of the packing case of the present invention in its formed configuration.
Figure 3:
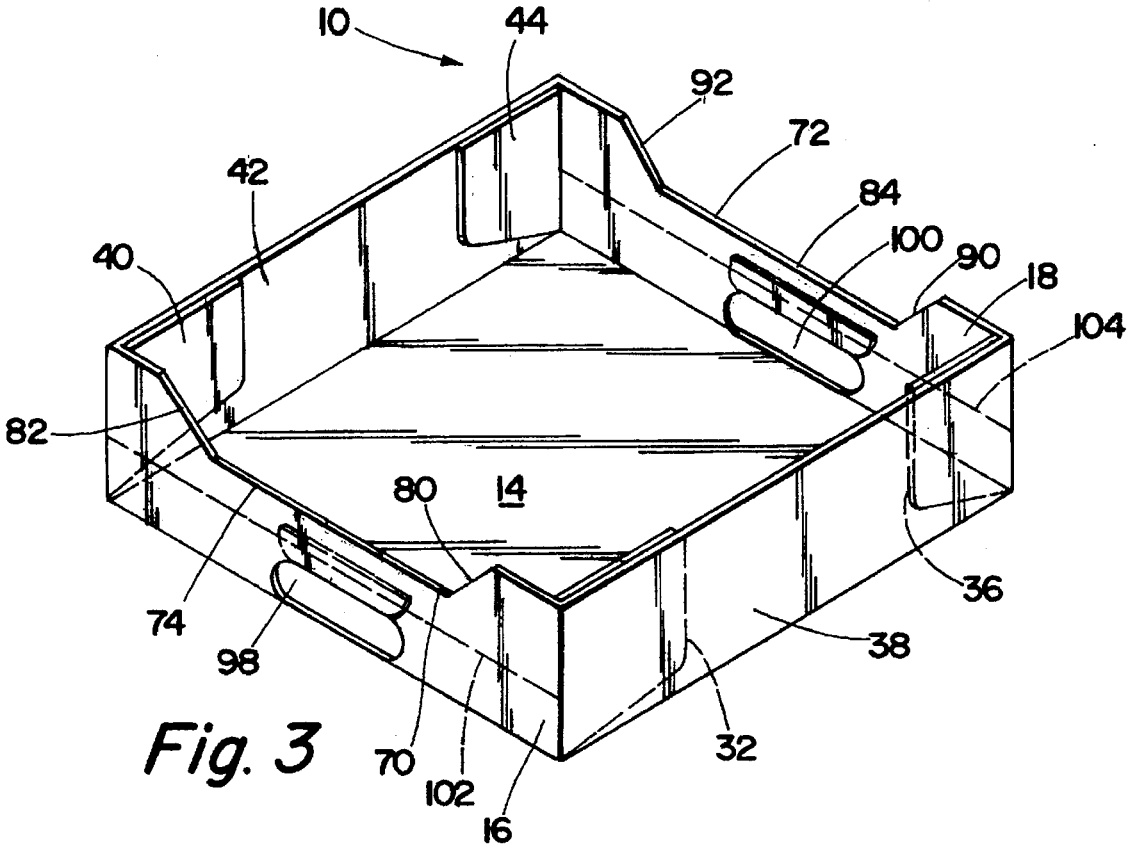
FIG. 3 is a perspective view of the packing case of the present invention with the top portion of the case removed.
Figure 4:
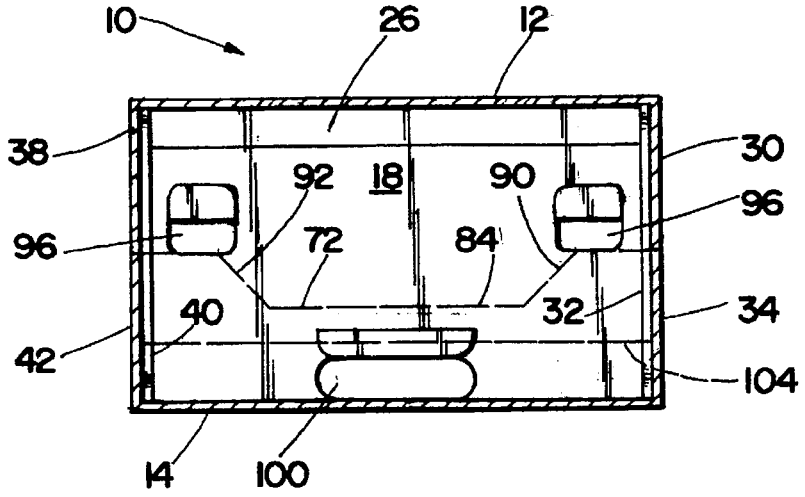
FIG. 4 is a cross-sectional view of the packing case of the present invention taken across section-indicating lines 4—4 in FIG. 2.

The blank 10 also includes end flaps 30, 32, 34, 36, 38, 40, 42 and 44, each being hingedly connected to either top panel 12, side panel 16 or 18, or bottom panel 14 by folding scores 46, 48, 50, 52, 54, 56, 58 and 60, respectively. The end flaps, when folded inwardly, provide the two end panels 62, 64 for the formed packing case, as illustrated in FIG. 2. End panel 62 is comprised of end flaps 30, 32, 34 and 36 and is formed such that end flaps 32 and 36 are concealed by end flaps 30 and 34. Similarly, end panel 64 is comprised of end flaps 38, 40, 42 and 44 and is formed such that end flaps 40 and 44 are concealed by end flaps 38 and 42. As shown in FIG. 4, the height of end flaps 30, 34 forming end panel 62 is such that their respective edges abut, but do not overlap, when the packing case is formed. Similarly, the height of end flaps 38, 42 forming end panel 64 is such that their respective edges abut, but do not overlap, when the packing case is formed.

The packing case of the present invention is provided with two tearing scores 70, 72 comprising a plurality of perforated slots which extend through side panels 16, 18, respectively and through respective adjacent end flaps 32, 40 and 36, 44. Each tearing score 70, 72 is comprised of alternating linear perforated slots and gaps, or interruptions, in the perforations. Tearing score 70 is comprised of a center portion 74 substantially parallel to folding score 20, end portions 76, 78, each substantially parallel to the center portion 74 and positioned so as to pass through the respective outer ends of side panel 16 and through end flaps 32, 40, respectively, and diagonal portions 80, 82, each at an angle of about 45° with respect to center portion 74 and each joining an end of center portion 74 with the end of its respective adjacent end portion 76, 78. Similarly, tearing score 72 is comprised of a center portion 84 substantially parallel to folding score 22, end portions 86, 88, each substantially parallel to the center portion 84 and positioned so as to pass through the respective outer ends of side panel 18 and through end flaps 36, 44, respectively, and diagonal portions 90, 92, each at an angle of about 45° with respect to center portion 84 and each joining an end of center portion 84 with the end of its respective adjacent end portion 86, 88. The location of end portions 76, 78 of tearing score 70 within respective end flaps 32, 40 and end portions 86, 88 of tearing score 72 within respective end flaps 36, 44 is such that end portions 76, 86 coincide with and are aligned with the abutting edges of end flaps 30, 34 while end portions 78, 88 coincide with and are aligned with the abutting edges of end flaps 38, 42 when the packing case is formed. Hinged perforated finger openings 94, having a curved configuration, are provided adjacent the junction of diagonal portions 80, 82 and end portions 76, 78, respectively, in tearing score 70. Similarly, hinged perforated finger openings 96, having a curved configuration, are provided adjacent the junction of diagonal portion 90, 92 and end portion 86, 88, respectively, in tearing score 72. Hinged lifting access openings 98, 100, each having a curved configuration at its outer ends, are respectively provided in the approximate center of side panels 16, 18, adjacent respective folding scores 20, 22. A strip 102, 104 of reinforcement material, such as sesame tape or String King, is provided within respective side panels 16, 18 and end panels 32, 40, and 36, 44, respectively, and is located between lifting access openings 98, 100, and tearing scores 70, 72, respectively, and oriented so as to be substantially parallel to folding scores 20, 22, respectively.

It should be noted that the corrugated cardboard from which the packing case of the present invention is to be formed should be cut such that the flutes or corrugations between the two outer faces of the board are substantially parallel to the tearing scores 70, 72 in side panels 16, 18, respectively. If the flutes or corrugations are oriented in the opposite direction, the tearing scores 70, 72 are more susceptible to tearing and consequently the resulting packing case would not withstand the stresses to which such cases are normally subjected in shipping.

After the packing cases of the present invention have been filled with containers, such as paint cans, and folded to enclose the containers, they are sealed by the application of glue or other conventional adhesive to the glue flap 26 and to end flaps 32, 36, 40 and 44, or to corresponding portions of the end flaps to which they will be joined when the packing case is formed and sealed, for example, to portions of end flaps 30, 34, 38 and 42. These latter end flaps are held to the packing case only by end flaps 32, 36, 40 and 44 to which they are joined. Alternatively, end flaps 32, 36, 40 and 44 and/or portions of end flaps 30, 34, 38 and 42 can be pre-glued when the blank 10 is produced.

The packing case of the present invention, when sealed, can be readily opened in a number of ways. For example, the packing case can be opened by placing one's fingers in one of the finger openings 94, 96 in side panels 16, 18, respectively, and lifting upwardly. The weight of the containers within the packing case will cause the top portion 110 of the packing case to separate from the bottom portion 112 thereof along tearing scores 70 and 72. Alternatively, by placing one or more fingers of one hand in finger opening 94 and one or more fingers of the other hand in diagonally oriented finger opening 96 and lifting upwardly causes the top portion 110 of the packing case to separate from the bottom portion 112 along tearing scores 70 and 72. It should be noted that either of the foregoing methods of opening a sealed case benefits from the weight of the containers therein, i.e., the weight of the containers opposes the upward force provided on the packing case through finger openings 94 or 96 and cause the top portion 110 of the packing case to separate from the bottom portion 112 along tearing scores 70 and 72.

The present invention provides a number of advantages over prior art packing cases. For example, the diagonal portion 80, 82 of the respective tearing scores 70, 72 provides the packing case with additional strength while minimizing unwanted tearing along tearing scores 70, 72 during shipping and handling. In addition, the inclusion of diagonal portions 80, 82 within respective tearing scores 70, 72 provides the corners of the packing cases with increased sturdiness and strength due to increased height in those locations while providing reduced height in the center portion thereof for display purposes. The configurations of the tearing scores 70, 72 also create a more attractive "tray" for the cans or containers since the tearing scores 70, 72 produce a relatively smooth edge for the bottom portion 112 of the packing case when the top portion 110 of the packing case is separated therefrom. In the prior art, the tearing scores typically create a crenelated edge, rather than a smooth edge as in the present invention. The utilization of strip 102, 104 of reinforcement material within respective side panels 16, 18 and end panels 32, 40, 36 and 44 provides a much higher degree of safety over prior art packing cases during lifting or handling of same. If one or both of the lifting access openings 98, 100 tear while the packing case is being lifted, the adjacent strip 102, 104 of reinforcement material is strong enough to permit handling of the packing case without the contents thereof falling out and possibly causing injury. Also, the position of the lifting access openings, 98, 100 in respective side panels 16, 18 so as to be adjacent bottom panel 14 prevents the sealed packing case from being lifted from the top which could cause unnecessary strain on a person's back. Thus, the person lifting the packing case is required to pick up the case from its bottom, rather than from its top. Lastly, the finger openings 94, 96 and the lifting access openings 98, 100 are curved putting less strain on the fingers and hands during the lifting of the sealed packing case.

The invention has been described in detail with particular reference to preferred embodiments thereof, but it will be understood that variations and modifications can be effected within the spirit and scope of the invention.

We claim:

1. A blank for the production of a case for packaging at least one container consisting of a double-face, single wall corrugated board scored with folding lines defining:

a) a top panel;

b) a bottom panel;

c) a first side panel hingedly joined by a folding score to the top panel and hingedly joined by a folding score to the bottom panel;

d) a second side panel hingedly joined by a folding score to the bottom panel;

e) a glue flap hingedly joined by a folding score to the top panel;

f) a lifting access opening located in the approximate center of each side panel adjacent the folding score hingedly joining each side panel to the bottom panel;

g) an end flap hingedly joined by a folding score to each of the oppositely disposed ends of the first and second side panels;

h) an end flap hingedly joined by a folding score to each of the oppositely disposed ends of the top and bottom panels and having dimensions such that, when the case is formed, the edges of said end flaps hingedly joined to the top and bottom panels abut one another and together form an end panel of the case;

each of said side panels and said end flaps to which said side panels are hingedly joined being provided with a tearing score comprising:

1. a first portion comprising a plurality of perforated slots positioned in the approximate center of said side panel;

2. a second portion comprising a plurality of perforated slots positioned in each of the outer ends of said side panel and in said end flaps to which said side panel is hingedly joined such that, when the case is formed, said plurality of perforated slots positioned in each of said end flaps is substantially aligned with said abutting edges of said end flaps hingedly joined to the top and bottom panels and, when the top portion of the case is separated from the bottom portion of the case, said separation occurs along said plurality of perforated slots positioned in each of said end flaps and along said abutting edges of said end flaps hingedly joined to the top and bottom panels; and 3. a third portion comprising a plurality of perforated slots interconnecting each end of said first portion of said tearing score with the adjacent end of said second portion of said tearing score; and i) at least one finger opening in one of said side panels, said at least one finger opening having a substantially laterally extending edge substantially parallel to and contacting said tearing score.

2. A blank for the production of a case for packaging at least one container consisting of a double-face, single wall corrugated board scored with folding lines defining:

a) a top panel;

b) a bottom panel;

c) a first side panel hingedly joined by a folding score to the top panel and hingedly joined by a folding score to the bottom panel;

d) a second side panel hingedly joined by a folding score to the bottom panel;

e) a glue flap hingedly joined by a folding score to the top panel;

f) a lifting access opening located in the approximate center of each side panel adjacent the folding score hingedly joining each side panel to the bottom panel;

g) an end flap hingedly joined by a folding score to each of the oppositely disposed ends of the first and second side panel;

h) an end flap hingedly joined by a folding score to each of the oppositely disposed ends of the top and bottom panels and having dimensions such that, when the case is formed, the edges of said end flaps hingedly to the top and bottom panels abut one another and together form and end panel of the case;

each of said side panels and said end flaps to which said panels are hingedly joined being provided with the tearing score comprising:

1.) a first portion comprising a plurality of perforated slots positioned in the approximate center of said side panel;

2.) a second portion comprising a plurality of perforated slots positioned in each of the outer ends of said side panel and in said end flaps to which said side panel is hingedly joined; and 3.) a third portion comprising a plurality of perforated slots interconnecting each end of said first portion of said tearing score with the adjacent end of said second portion of said tearing score; and i) at least one finger opening in each of said side panels positioned so as to be adjacent said tearing score, said finger opening comprising a perforated opening positioned adjacent the junction of said second and third portions of said tearing score.

3. A blank for the production of a case for packaging at least one container consisting of a double-face, single wall corrugated board scored with folding lines defining:

a) a top panel;

b) a bottom panel;

c) a first side panel hingedly joined by a folding score to the top panel and hingedly joined by a folding score to the bottom panel;

d) a second side panel hingedly joined by a folding score to the bottom panel;

e) a glue flap hingedly joined by a folding score to the top panel;

f) a lifting access opening located in the approximate center of each side panel adjacent the folding score hingedly joining each side panel to the bottom panel;

g) an end flap hingedly joined by a folding score to each of the oppositely disposed ends of the first and second side panel;

h) an end flap hingedly joined by a folding score to each of the oppositely disposed ends of the top and bottom panels and having dimensions such that, when the case is formed, the edges of said end flaps hingedly to the top and bottom panels abut one another and together form and end panel of the case;

each of said side panels and said end flaps to which said panels are hingedly joined being provided with the tearing score comprising:

1. a first portion comprising a plurality of perforated slots positioned in the approximate center of said side panel;
2. a second portion comprising a plurality of perforated slots positioned in each of the outer ends of said side panel and in said end flaps to which said side panel is hingedly joined; and
3. a third portion comprising a plurality of perforated slots interconnecting each end of said first portion of said tearing score with the adjacent end of said second portion of said tearing score; and i) at least one finger opening in one of said side panels, said at least one finger opening having a laterally extending edge being substantially parallel to and contacting said tearing score.

4. The blank as defined in claim 3 wherein said second portion of said tearing score is substantially parallel to said first portion of said tearing score.

5. The blank as defined in claim 3 wherein said first portion of said tearing score is substantially parallel to the folding score which hingedly joins said side panel to said bottom panel of said case.

6. The blank as defined in claim 3 wherein said third portion of said tearing score is positioned on a diagonal with respect to said first and second portions of said tearing score.

7. The blank as defined in claim 3 wherein said tearing score is comprised of a plurality of substantially linear perforated slots separated by gaps therebetween.

8. The blank as defined in claim 3 wherein said plurality of perforated slots in said first, second and third portions of said tearing score are substantial linear in each of said portions.

9. The blank as defined in claim 3 wherein said tearing score is comprised of a plurality of substantially linear perforated slots separated by gaps therebetween.

10. The blank as defined in claim 3 wherein said finger opening is comprised of a perforated opening positioned adjacent the junction of said second and third portions of said tearing score.

* * * * *